US006293988B1

(12) United States Patent
Naro

(10) Patent No.: US 6,293,988 B1
(45) Date of Patent: Sep. 25, 2001

(54) INOCULANT AND INOCULANT METHOD FOR GRAY AND DUCTILE CAST IRONS

(76) Inventor: Rodney Louis Naro, 19620 Edgecliff Dr., Euclid, OH (US) 44119

( * ) Notice: Subject to any disclaimer, the term of this patent is extended or adjusted under 35 U.S.C. 154(b) by 0 days.

(21) Appl. No.: 09/128,429

(22) Filed: Aug. 4, 1998

(51) Int. Cl.[7] ..... C21C 7/04; C22B 9/10; C22C 1/06

(52) U.S. Cl. ..... 75/305; 75/328; 75/329; 75/562; 75/567; 420/87; 420/117

(58) Field of Search ..... 75/252, 255, 303, 75/305, 328, 329, 562, 567, 569, 570; 420/78, 83, 87, 117, 578, 580, 581

(56) References Cited

U.S. PATENT DOCUMENTS 3,798,027 * 3/1974 Defranco et al. ..... 75/124
4,390,362 * 6/1983 Khusnutdinov et al. ..... 75/49
5,008,074 * 4/1991 Naro et al. ..... 420/578
5,100,612 * 3/1992 Obata et al. ..... 420/13
5,268,141 * 12/1993 Ototani et al. ..... 420/8
6,102,983 * 8/2000 Skaland ..... 75/568

* cited by examiner

*Primary Examiner*—Roy King
*Assistant Examiner*—Harry D. Wilkins, III
(74) *Attorney, Agent, or Firm*—Renner, Otto, Boisselle & Sklar, LLP

(57) ABSTRACT

A new technique for producing ferrosilicon free inoculating agents for gray and ductile irons utilizing oxy-sulfide forming elements combined with sulfur and oxygen and 1) mechanically pressed into an insert or tablet for placement into foundry sand molds or 2) a mixture of the same ingredients used as a loose or granular addition to molten iron. The inoculating agent is composed of 15 to 49% silicon, 7 to 22% calcium, 2.5 to 10% sulfur, 2 to 4% oxygen, 2.5 to 7.5% magnesium and 0.5 to 5% aluminum with the balance iron and incidental impurities, wherein the iron is the primary densification agent.

20 Claims, No Drawings

INOCULANT AND INOCULANT METHOD FOR GRAY AND DUCTILE CAST IRONS

BACKGROUND OF THE INVENTION

This invention relates to 1.) a composition of material which is capable of graphitizing cast iron in a highly effective and efficient manner, and 2.) the invention relates to combining and blending sulfur and oxygen compounds with other elements that are potent oxy-sulfide formers (such as rare earths, zirconium, calcium, zirconium, aluminum, barium, strontium, magnesium and titanium and which will heretofore be classified as 'oxy-sulfide formers', individually or in selected amounts), such blended compounds to be used to 1.) fabricate either a high density, inoculating 'insert' or 'tablet' or 2.) a granular or powder mixture of essentially the same composition which can be used as a direct addition to the molten metal.

The usual microstructure of gray iron is a matrix of ferrite and pearlite with graphite flakes dispersed throughout. Foundry metallurgical practices include 'inoculating the metal' so that nucleation and growth of graphite flakes occurs in a pattern that enhances the desired properties. The 'inoculating agent' can be added to either 1.) the pouring ladle, 2.) injecting or spraying the inoculant (in a finely divided or powdered form) into the metal pouring stream as the molten metals enters the mold, or as a insert placed in the mold. The amount, size and distribution of graphite are important to the physical properties of the gray iron. The use of inoculants to control microstructure as well as reduce the 'chilling tendency or the formation of iron carbides (or cementite) is common practice in the ferrous foundry industry. The presence of "iron carbides" in the iron matrix is undesirable because this constituent is hard and brittle and can result in poor mechanical properties and machinability.

In ductile irons, the usual microstructure is a matrix of ferrite and pearlite with graphite nodules dispersed throughout the structure. Similar to gray cast iron, the nucleation and growth of the graphite nodules can be controlled by adding 'post inoculants' to either the ladle, as an instream inoculant or as a insert placed at a strategic location in the mold. The size, shape and distribution of the graphite 'nodules' is important to the physical properties of the ductile iron.

Inoculants can best be described as elements that can form stable compounds with either/or sulfur and oxygen, or both. These oxy-sulfide atomic clusters provide a substrate surface upon which dissolved graphite in the molten iron can "nucleate upon" or start to grow as graphite flakes or nodules, before sufficient undercooling occurs that favors the formation of "carbides".

Numerous metals and alloys have been proposed for use as inoculating agents in the production of both gray and ductile iron castings. Standard inoculating agents are 1.) calcium silicon, 2.) calcium bearing ferrosilicon alloys or other ferrosilicon based alloys that contain small percentages of oxy-sulfide forming elements and 3.) finely divided and powdered synthetic graphite.

In the manufacture of gray cast iron and ductile cast iron, it is almost essential to make an addition of an either a calcium bearing ferrosilicon or one of the more potent ferrosilicon inoculants containing relatively small percentages of oxy-sulfide forming elements prior to pouring the casting. In the case of the latter addition, these 'oxy-sulfide' forming elements combine with dissolved oxygen and sulfur in the liquid iron. In almost all cases, the purpose of the ferrosilicon is to act as a 'carrier' for the 'oxy-sulfide forming elements' and ferrosilicon by itself provides little to no inoculating effect. Only certain amounts of these 'inoculating capable elements' (or oxy-sulfide forming elements) can be technically and feasibly smelted and alloyed with ferrosilicon to produce commercially and economically available alloy products. This is largely due to the limited solubilities of the oxy-sulfide forming elements in liquid ferrosilicon alloys. It should be mentioned that ferrosilicon is used as the "carrier medium" because ferrosilicon is relatively inexpensive and dissolves quite easily when added to cast irons, thereby liberating through dissolution in the molten iron the small amounts of elements that react with dissolved oxygen and sulfur. Inoculation without using ferrosilicon inoculants but using oxy-sulfide forming elements was shown by the authors of "Minor Elements in Gray Iron", R. L. Naro and J. F. Wallace, American Foundrymen's Society, Transactions of the AFS, Volume 78, p. 229 (1970) ("Reference 1").

One such inoculant is known by the tradename of Superseed or Stronsil. This group of inoculants are strontium bearing ferrosilicon alloys containing small amounts of strontium (less than 1%) to promote Type A graphite flakes and minimize the formation of iron carbides. Another such ferrosilicon inoculant containing strontium, calcium and either zirconium or titanium is disclosed in U.S. Pat. No. 4,666,516. Another titanium ferrosilicon alloy, this one containing magnesium is disclosed in U.S. Pat. No. 4,568, 388. Finally, inoculating alloys for gray iron are also known which include barium, e.g., U.S. Pat. No. 3,137,570 and 5,008,074.

Inoculants are commonly added to the metal pouring ladle prior to the actual casting process. A major problem in using any of the above inoculants as a ladle addition is that the inoculants' effectiveness diminishes rather rapidly after it is added. Thus, the first castings poured usually have improved microstructures and graphite structures versus those poured with metal from the same ladle only a minute or 2 later. This process of diminished effectiveness of inoculants with time at elevated metal pouring temperatures is know as 'fade'. To circumvent 'inoculant fade', some of the same inoculating alloys are used in a powdery or granular form and injected into the metal stream just prior to entering the mold. These methods are usually more effective and normally much smaller addition levels need to be made. However, mechanical problems associated with the actual 'injection' process as well as timing of the injected powder with the metal stream may be the source of inconsistent results and contamination of molding sands from 'overspray' inoculants.

Inoculating in the mold is a third alternative, although it is not widely used. Either small lumps of calcium bearing ferrosilicon can be used or alternately, cast inserts made with ferrosilicon may be used. Since inoculation proceeds at the very last moment and virtually no time is available for fade, even smaller amounts of inoculant may be used as reported by the authors in "Chill Elimination in Ductile Iron by Mold Inoculation", W. Dell, Deere & Co. American Foundrymen's Society Publication 'Conference on Modern Inoculating Practices for Gray and Ductile Iron', Feb. 6–7, 1979, p. 283 ("Reference 2"). Efforts to make tablets with "inoculant containing materials" employing "molten wax" binders and have not met with commercial success. Reference 1 clearly states that wax bonded inoculants did not produce the desired effects. Recently, compacted and sintered fines of magnesium ferrosilicon and other silicon containing alloys have been produced in the shape of a tablet have been introduced to the market.

Traditional inoculants do not contain intentional additions of sulfur nor oxygen and must rely on the potential reaction of the 'oxy-sulfide' forming elements which are added to traditional inoculants. Traditionally, all ferrosilicon based inoculants are smelted and refined in submerged arc furnaces and it is technically unfeasible to smelt sulfur and oxygen with these alloys because of liquid solubility constraints. It is also difficult if not impossible to incorporate significant amounts of these property enhancing elements (sulfur and oxygen) in traditional smelted ferroalloys.

The effectiveness of all inoculating agents is a direct function of the amount of sulfur dissolved in the molten irons and to a lesser extent, the amount of dissolved oxygen. The ability of 'oxy-sulfide' forming elements to form nuclei assisting substrates, ie, oxy-sulfide atomic clusters, which in turn provides a similar crystalline surface onto which dissolved graphite atoms can precipitate from the liquid iron and grow is a necessary prerequisite for inoculation. Incorporation of sulfur and oxygen containing elements in the inoculant, thus insures that sufficient sulfur and oxygen will be available for subsequent reaction with the 'oxy-sulfide' elements added as inoculants. Addition of these sulfide and oxygen compounds rejuvenates and beneficiates the molten iron and improves its responsiveness to inoculation.

BRIEF SUMMARY OF THE INVENTION

It is an object of this invention to provide a potent, essentially ferrosilicon free inoculating agent which causes the cementite in the iron to be substantially eliminated and the graphite to be evenly distributed in a beneficial manner throughout the cross section of the resultant casting. The form of the inoculant agent can be either 1.) a very dense 'insert' or 'tablet' or 2.) a mixture of the same elements in loose or granular powder form. The range of chemistries available using this approach are much broader and allows the incorporation of concentrated levels of the critical elements needed for the inoculation process compared to traditional inoculating alloys which are produced by a smelting and casting process.

In the case of inoculant tablets, the product is produced on a high pressure press and which utilizes iron powder as the primary 'carrier' and densification agent. The iron powder provides improved specific gravity and heat transfer for improved alloy dissolution. The iron powder provides a source of 'mechanical particle interlocking' that assists in the consolidation of the alloy ingredients into a tablet which possesses outstanding green handling properties. Use of iron as the "carrier" agent essentially eliminates the need for ferrosilicon based inoculating alloys.

Another object of this invention relates to maximizing the number of nucleation sites on which graphite forms and grows by providing additional oxy-sulfide nucleation sites. Sulfur and oxygen are incorporated into either ferrosilicon free 1.) inoculant inserts or tablets or 2.) blended powders. The addition of both sulfur and oxygen compounds allows them to combine with the other 'oxy-sulfide' forming elements which are also incorporated in the insert or granular blends. These additional nucleating sites provide improved microstructures in gray cast iron which is mostly Type A graphite flakes; in ductile iron, the resultant microstructure will consist of higher nodule counts and reduced carbides.

Our invention is an inoculating 'insert' or loose granular powder made with varying blends of oxy-sulfide forming elements blended to form a mixture consisting essentially of 1.) 15–49% silicon, 7 to 22% calcium, 3 to 10% sulfur, 2 to 4% oxygen, 2.5 to 7.5% magnesium and 0.50 to 5.0% aluminum, the balance being iron and incidental impurities.

A preferred form of the inoculating insert or tablet consists of essentially about 15% silicon, 7.0% calcium, 3.0% sulfur, 4.5% aluminum, 2.0% oxygen, 5.0% magnesium, the balance being iron and incidental impurities. The preferred granulated inoculant consists of 49% silicon, 22% calcium, 2.7% magnesium, 2.8% sulfur, 2.8% oxygen, 1.5% rare earths, and 3.5% aluminum.

In the case of gray cast iron, the 'insert or tablet' or granular loose mixture is characterized by a microstructure having at least 80% Type A graphite; in the case of ductile iron, the microstructure has 98% nodularity and is carbide free.

DETAILED DESCRIPTION OF THE INVENTION

My composition is a tablet or inmold insert containing concentrated amounts of sulfide and oxide forming elements. The tablet contains enough inoculating elements to effectively inoculate molten gray or ductile iron as the metal flows through the gating system during mold filling. The concentrated levels of inoculating elements gives an improved microstructure and chill reduction and dissolves rapidly without the use of auxiliary binders or energy consuming sintering.

The silicon levels in the tablet are maintained at above 15% so as to provide exothermicity or a positive heat of solution and to assist other slower dissolving additions so as to improve the dissolution rate of the inoculant. Various levels of oxy-sulfide forming elements, may be added to the base alloy blend to enhance properties for specific applications.

The testing of the inmold inserts produced complete dissolution in 35 lb castings having a pouring time of 8 seconds. The gray iron exhibited a uniform microstructure having a matrix of pearlite with 100% Type A graphite flakes dispersed throughout. In tests with difficult to product ductile irons prone to carbide formation, nodule counts were increased and nodularity was improved; the matrix was free of carbides. Other foundry tests with loose granular mixtures of the 'oxy-sulfide' forming elements in ductile iron produced high quality ductile iron with excellent impact properties with relatively very low alloy addition rates. Lastly, the incorporation of one single 8.0 grams tablet improved the mechanical properties (elongation) of a Ni-resist ductile iron casting by 10%.

The inoculant tablet is silvery gray in appearance and is very dense. Specific gravity is in the range of 2.2 to 2.5 grams/cc. The tablet has a high solubility in cast iron with temperatures as low as 2250° F. The blend of ingredients used for tablet fabrication, but without the iron powder, can also be used in the granular form and have provided similar property improvement.

The results of the field trials demonstrate that the inoculant can be used in exceedingly small amounts and is not subject to 'fade'. Since such small additions are made, the inoculant is an economical approach to ladle inoculation, more 'fool proof' than stream injection, and vastly superior to other inmold inserts because of the varieties of blends of oxy-sulfide forming elements that may be used along with, most importantly, the addition of sulfur and oxygen to the inoculant to provide additional sources of oxy-sulfide nucleation sites. The inserts or tablets can also be used as a secondary late inoculant in the mold to ensure uniform property improvement.

References:

Ref. 1: "Minor Elements in Gray Iron", R. L. Naro and J. F. Wallace, American Foundrymen's Society, Transactions of the AFS, Volume 78, pp. 229, 1970

Ref. 2: "Chill Elimination in Ductile Iron by Mold Inoculation", W. Dell, Deere & Co. American Foundrymen's Society Publication 'Conference on Modem Inoculating Practices for Gray and Ductile Iron', Feb. 6–7, 1979, pp. 283

What I claim is:

1. An inoculating inmold insert or tablet for gray iron and ductile irons, the insert or tablet being made of an alloy consisting essentially of 15 to 49% silicon, 7 to 15% calcium, 3 to 10% sulfur, 2 to 4.0% oxygen, 2.5 to 7.5% magnesium and 0.50 to 5.0% aluminum, the balance being iron and incidental impurities, wherein the iron is the primary densification agent.

2. A granular alloy mixture consisting essentially of 45 to 49% silicon, 15 to 22% calcium, 2.5 to 10% sulfur, 2 to 4.0% oxygen, 1.5% rare earths, 2.5 to 5.0% magnesium and 3.0 to 4.0% aluminum, the balance being iron and incidental impurities.

3. An inoculating agent for gray or ductile iron, the agent comprising sulfur, oxygen, and one or more oxy-sulfide formers, wherein the agent is substantially ferrosilicon free.

4. The inoculating agent of claim 3, wherein the one or more oxy-sulfide formers includes calcium.

5. The inoculating agent of claim 4, further comprising silicon.

6. The inoculating agent of claim 3, further comprising iron.

7. An inoculating agent for gray or ductile iron, the agent comprising 15 to 49% silicon, 7 to 22% calcium, 2.5 to 10% sulfur, and 2 to 4% oxygen, the balance being iron and incidetal impurities and optionally including one or more additional elements selected from the group consisiting of aluminum, magnesium and rare earths, wherein the agent is substantially ferrosilicon free.

8. The inoculating agent of claim 7, wherein the agent includes 3 to 10% sulfur.

9. The inoculating agent of claim 7, wherein the agent includes 7 to 15% calcium.

10. An inoculating agent for gray or ductile iron, the agent comprising about 15% silicon, about 7% calcium, 2.5 to 10% sulfur, and 2 to 4% oxygen the balance being iron and incidental impurities and optionally including one or more additional elements selected from the group consisting of aluminum, magnesium and rare earths.

11. The inoculating agent of claim 7, wherein the agent includes about 3% sulfur and about 2% oxygen.

12. An inoculating agent for gray or ductile iron, the agent comprising 45 to 49% silicon, 15 to 22% calcium, 2.5 to 10% sulfur, and 2 to 4% oxygen the balance being iron and incidental impurities and optionally including one or more additional elements selected from the group consisting of aluminum, magnesium and rare earths.

13. The inoculating agent of claim 7, wherein the balance of the agent includes one or more additional elements selected from the group consisting of aluminum, magnesium and rare earths.

14. The inoculating agent of claim 7, wherein the agent is in granular form.

15. The inoculating agent of claim 7, wherein the agent is in insert or tablet form.

16. The inoculating agent of claim 7, wherein the agent includes aluminum and magnesium.

17. The inoculating agent of claim 16, wherein the agent includes 2.5 to 7.5% magnesium and 0.5 to 5% aluminum.

18. The inoculating agent of claim 7, wherein the agent includes at least one rare earth.

19. An inoculating agent for gray or ductile iron, the agent comprising 15 to 49% silicon, 7 to 22% calcium, 2.5 to 10% sulfur, and 2 to 4% oxygen, and iron, wherein the agent is in insert or tablet form, and wherein the iron is the primary densification agent.

20. The inoculating agent of claim 19, wherein the agent is substantially ferrosilicon free.

* * * * *